US005278744A

United States Patent [19]

Geboers et al.

[11] Patent Number: 5,278,744

[45] Date of Patent: Jan. 11, 1994

[54] ILLUMINATION DEVICE AND LUMINAIRE FOR USE THEREIN

[75] Inventors: Jaak M. J. Geboers, Aachen, Fed. Rep. of Germany; Manfred Kiesling, Oirsbeek, Netherlands

[73] Assignee: U.S. Philips Corporation, New York, N.Y.

[21] Appl. No.: 896,808

[22] Filed: Jun. 9, 1992

Related U.S. Application Data

[63] Continuation of Ser. No. 769,609, Oct. 1, 1991, abandoned.

[30] Foreign Application Priority Data

Oct. 1, 1990 [NL] Netherlands ..... 9002136

[51] Int. Cl.[5] ..... F21V 7/00

[52] U.S. Cl. ..... 362/348; 362/16; 362/255; 362/346

[58] Field of Search ..... 362/16, 17, 255, 263, 362/294, 297, 345, 346, 348, 350

[56] References Cited

U.S. PATENT DOCUMENTS

| | | | |
|---|---|---|---|
| 3,826,913 | 7/1974 | Downing et al. | 362/348 |
| 4,021,659 | 5/1977 | Wiley | 362/297 |
| 4,293,892 | 10/1981 | Plummer | 362/17 |
| 4,414,613 | 11/1983 | Mayer | 362/350 |
| 4,494,176 | 1/1985 | Sands et al. | 362/350 |
| 4,536,831 | 8/1985 | English et al. | 362/297 |
| 4,545,000 | 10/1985 | Fraley et al. | 362/348 |
| 4,672,514 | 6/1987 | Giller | 362/297 |
| 4,855,886 | 8/1989 | Eijkelenboom et al. | 362/346 |
| 4,914,557 | 4/1990 | Maassen et al. | 362/346 |

*Primary Examiner*—Richard R. Cole
*Assistant Examiner*—Y. Quach
*Attorney, Agent, or Firm*—Brian J. Wieghaus

[57] ABSTRACT

The illumination device comprises a housing, a lampholder, a reflector and an electric lamp having a base rigidly connected to its light-diffusing lamp vessel. A light source within the lamp vessel is disposed substantially coaxially with an optical axis of the reflector. The reflector is polygonal in cross sections transverse to its axis and shapes the light generated into a beam, the intensity of which increases from $I_0$ along the optical axis to a value of 105 to 130% thereof at an angle of 5 to 25% to the axis. Scenes illuminated by the device yield evenly exposed photo, film and video images.

30 Claims, 2 Drawing Sheets

ILLUMINATION DEVICE AND LUMINAIRE FOR USE THEREIN

This is a continuation of application Ser. No. 07/769,609, filed on Oct. 1, 1991 now abandoned.

BACKGROUND OF THE INVENTION

The invention relates to an illumination device comprising:

- a housing,
- a lamp holder and a concave reflector having an optical axis in the housing;
- an electric lamp comprising a light-diffusing lamp vessel and light source inside the lamp vessel, arranged inside the reflector and substantially coaxial with the reflector;
- a lamp cap securely connected to the lamp vessel and accommodated in the lamp holder.

The invention also relates to a capped lamp/reflector unit suitable for use in this device.

Such a device is known from EP 0 168 016A. The known device is designed for use as a portable mine illumination device. Its electric lamp has an outer bulb which scatters light just as, or instead of the lamp vessel.

Without a light-scattering lamp vessel and/or outer bulb, the lamp in conjunction with the reflector would give a narrow light beam with a high intensity in the beam centre and a quick intensity decrease at small angles to the centre. If an envelope having a light-scattering surface obtained by sandblasting or chemical etching is used, the intensity in the beam centre is much lower and the intensity initially decreases slowly from the centre, and later more quickly. The beam as a result is much wider. A larger surface can be illuminated with the beam, but less brightly. A further intensification of these effects is obtained through the use of a second light-scattering envelope.

A disadvantage of an envelope frosted by sandblasting, and similarly of such an envelope frosted chemically, is that the frosting causes some reduction of the luminous flux, approximately 5 to 6 percents, as a result of light absorption.

Light-scattering means are also used in commercially available illumination devices of the construction described and designed for making video registrations. Thus, devices are known in which the luminous window of the reflector is covered by a frosted pane; other devices have reflectors whose concave surface is rough.

Light-scattering means not only yield a wider beam of a lower intensity in the centre thereof and a gradual decrease of this intensity outside the centre, but also a greater rotational symmetry of the beam. Deviations in the rotational symmetry of the lamp itself, for example, owing to a current supply conductor which runs alongside the light source, are reduced by such means, while the evenness of the beam is increased. A screen illuminated with such a beam has an illuminated field which is to a considerable degree rotationally symmetrical. The illuminated field has an illuminance which is very even, not only as regards rotational symmetry, but also diametrically: a comparatively high illuminance in the centre and a gradual decrease therefrom towards the outer edge.

The known illumination devices, however, have the disadvantage that video, film, or photographic shots of a poor illumination quality are obtained when these devices are used, in spite of the evenness of the beam formed by these devices and the even illumination of the field covered by this beam.

SUMMARY OF THE INVENTION

The invention has for its object to provide an illumination device of the kind described in the opening paragraph as well as a lamp/reflector unit suitable therefore, which renders images of a high illumination quality possible.

According to the invention, this object is achieved in that the reflector is a polygon in cross-sections transverse to its axis and forms a light beam whose intensity around the optical axis in a direction away from this axis up to a direction which encloses an angle of between 5° and 25° with this optical axis increases to a value which lies between 105 and 130% of the intensity on the optical axis.

The size of the said angle is chosen in dependence on the aperture angle of the objective of the camera in conjunction with which the device or the lamp/reflector unit is to be used.

When a screen is irradiated with the beam formed by the illumination device, an illuminated field is obtained which is diametrically uneven, but is to a high degree rotationally symmetrical. Nevertheless, a picture shot of this field surprisingly is of a very good and even illumination quality.

The invention is based on the following insight.

The illumination quality of a field as judged by the eye is not a measure for the illumination quality of photographic pictures obtained of that field. The human eye expects a field having a high illuminance in the centre and a gradual, strong or less strong decrease from there towards the edge when a screen is irradiated with a light beam. If the said decrease is even around the centre of the field, the field is subjectively judged by the eye as being evenly illuminated. A screen illuminated by a device according to the invention does not have the greatest illuminance in the centre of the field and is accordingly not judged by the eye as evenly illuminated, but as a field having a dark spot in the centre. When a picture made by a camera is judged, however, the viewer does not start from the assumption that the picture is made with the use of a movie light. It is required that the picture of the recorded field has the same brightness everywhere.

The camera which records the picture is objective. It only registers where how much light originates from the various spots of the field and enters the objective, and records these data. In the centre of the field only light coming from a movie light is incident perpendicularly on the screen and is sent to the objective of the camera by mirrored reflection, while from other spots only a small portion of the incident light will arrive and end up in the objective of the camera as a result of diffuse scattering. Light mirrored from these other spots will not enter the objective since it is reflected sideways of the camera. In order to obtain through diffuse scattering more light in the objective from spots around the centre, accordingly, not less, as is usual, and not as much, but even more light must be directed towards these spots than to the centre. So to the eye the centre must appear darker.

To achieve that the reflector sufficiently spreads the light generated by the light source, it is necessary for the reflector to be a polygon in cross-sections transverse to the optical axis, i.e. to have lanes which run in axial direction and which are plane in a direction transverse to the axis. The light-scattering lamp vessel thereby prevents radial dark lines appearing on a screen illuminated by the device, formed by the axial bends in the reflector, the lines along which the lanes adjoin one another.

Being aware of the insight as described and the measure arising from it, those skilled in the art are definitely capable of designing a reflector with a defined reflector size for a defined light source which yeilds in conjunction with the said light source the light beam as formed by the device according to the invention.

In an attractive embodiment of the device and of the lamp/reflector unit according to the invention, the reflector is faceted, i.e. the axial lanes have bents in axial direction. The reflector may then be built up of bent rings which encircle the axis.

The reflector may be a total reflector made of metal, for example of aluminium, or of, for example, glass or synthetic material vapourized with metal, or alternatively a cold-beam mirror: a selective reflector which mainly reflects the visible radiation and transmits infrared radiation. A dichroic mirror may be used for this, built up of alternating layers of high and of low refractive index on a body of, for example, glass or synthetic material.

The light source of the lamp may be an incandescent body, for example of tungsten, the gas filling then containing a halogen or halogen compound, for example HBr, or alternatively a pair of electrodes. In the latter case the gas filling may be, for example, xenon under high pressure, for example several kPa, possibly with mercury and/or a metal halide.

It is favourable to close off the reflector with a light-transmitting, for example transparent glass disc. This measure promotes safety since contact with the lamp vessel is made impossible. Touching of the lamp vessel can involve the risk of burning or singeing, while contact with a cold lamp is to be avoided as well, to counteract pollution and the risk of crystallization of the glass. The escape of UV radiation is also counteracted. In a favourable embodiment, the disc has a glued connection with the reflector, for example, by means of silicone glue. The glued connection may have interruptions along the circumference of the disc, so that the space inside the reflector is in contact with the surroundings and can ventilate.

The base of the lamp may be integral with the reflector or with the lamp vessel. The base may be, for example, a neck-shaped portion of the reflector, in which portion the lamp vessel may be fixed by means of, for example, cement or mechanical means. The base may alternatively be, for example, a seal of the lamp vessel around a current supply conductor to the electric element, for example a wedge base. It is also possible for a separate body to be fastened to the reflector or to the lamp vessel by way of lamp cap. In an alternative embodiment of the device, the electric lamp is indetachably included in the reflector. The differences between these embodiments are of no influence on the essence of the invention.

In a preferred embodiment, the lamp vessel is satin-frosted in order to render in light-scattering. The lamp vessel as a result has a warm-white silky appearance in contrast to a lamp vessel frosted by etching or sandblasting, which is grey. The advantage is that the lamp vessel absorbs substantially no light, at most only 1–2%, which can be ascertained by comparing the quantity of light generated with the quantity of light generated by the same lamp after the lamp vessel has been made transparent again by etching with HF. Satin-frosting of the lamp vessel may be realised, for example, by means of a suspension of ammonium bifluoride in HF.

BRIEF DESCRIPTION OF THE DRAWINGS

Embodiments of the illumination device and of the lamp/reflector unit according to the invention are shown in the drawings.

In the drawings

DESCRIPTION OF THE PREFERRED EMBODIMENTS

Figure 1:
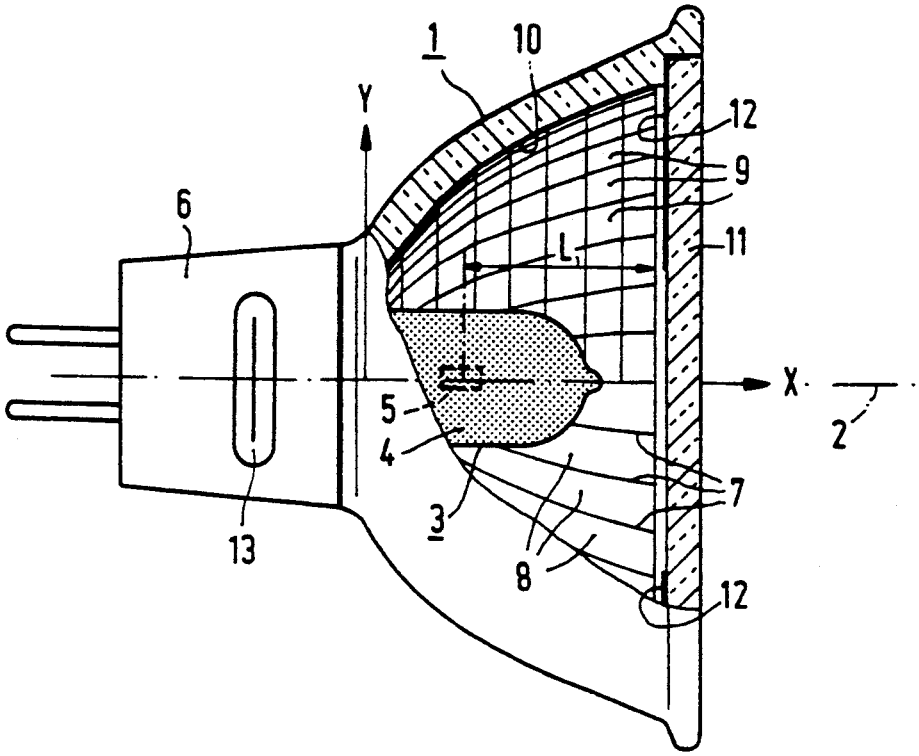
FIG. 1 shows the lamp/reflector unit partly in side elevation, partly in cross-section.

The lamp/reflector unit of FIG. 1 has a concave reflector 1 having an optical axis 2. An electric lamp 3 has a light-scattering lamp vessel 4, for example of glass having an $SiO_2$ content of at least 95% by weight, such as quartz glass. The lamp vessel 4 has an electric element 5 inside the reflector 1 and substantially coaxial with the reflector 1. In the Figure, the electric element, or light source, is an incandescent body, while the lamp vessel has a gas filling comprising a halogen compound. A lamp cap 6 is securely connected to the lamp vessel 4. In the unit drawn, the lamp cap 6 and the lamp vessel 4 are fastened to the reflector 1 with cement.

The reflector 1 is a polygon in cross-sections transverse to its axis 2, forming a light beam whose intensity around the optical axis 2, in a direction away from this axis up to a direction which encloses an angle of between 5° and 25° with this optical axis 2, increases to a value which lies between 105 and 130% of the intensity on the optical axis.

In these Figures, the corner points of the polygons of the cross-sections transverse to the optical axis 2 are represented with lines 7. The lines mark the lateral boundaries of the axially extending lanes 8, which are plane in these cross-sections.

In the same Figure, a second embodiment is indicated above the optical axis 2, in which the lanes 8 of the portion below the optical axis are subdivided into facets 9, which are flat also in axial direction of the reflector.

The reflector has a mirroring surface 10, in the drawing an interference filter of alternating layers of $SiO_2$ of low refractive index and ZnS of high refractive index, which reflects visible radiation and transmits IR radiation.

A flat disc 11, for example made of glass, closes the reflector 1. The disc has an interrupted glue connection 12 with the reflector 1 of, for example, silicone cement.

The lamp vessel 4 is satin-frosted and has a warm-white silky surface.

The reflecting surface of the reflector of FIG. 1 goes through points having the coordinates given in Table 1. In this Table, the x-axis coincides with the optical axis and the y-axis is perpendicular thereto.

TABLE 1

| x (mm) | y (mm) |
|---|---|
| 0.000 | 3.000 |
| 0.230 | 4.334 |
| 0.681 | 5.826 |

TABLE 1-continued

| x (mm) | y (mm) |
|---|---|
| 1.411 | 7.537 |
| 2.532 | 9.569 |
| 4.255 | 12.104 |
| 6.843 | 14.086 |
| 10.397 | 16.222 |
| 15.410 | 18.512 |
| 19.700 | 19.930 |

In the embodiment having lanes 8, a fluent line goes through these coordinates, lying centrally between two lateral boundaries 7. In the embodiment having facets, straight line sections run between the coordinates and over the centres of the facets. Both the lanes 8 and the facets 9 have a centre angle of 10°. In the embodiment drawn, accordingly, there are 36 lanes or 36 rows of facets, as the case may be.

The lamp cap 6 has a lateral profile 13 for positive retention by a lamp holder.

The lamp/reflector unit of FIG. 1 was manufactured in various versions, the characteristic parameters of which are listed in Table 2.

TABLE 2

| | | Incandescent body | | |
|---|---|---|---|---|
| Power (W) | Voltage (V) | $\phi$ (mm) | Length (mm) | Centre (x-coord.) |
| 20 | 6 | 0.714 | 1.36 | 5.5 |
| 35 | 6 | 1.085 | 1.45 | 5.5 |
| 50 | 6 | 1.264 | 1.96 | 5.4 |
| 35 | 12 | 1.000 | 2.46 | 5.1 |
| 50 | 12 | 1.283 | 2.63 | 5.2 |

Figure 2:
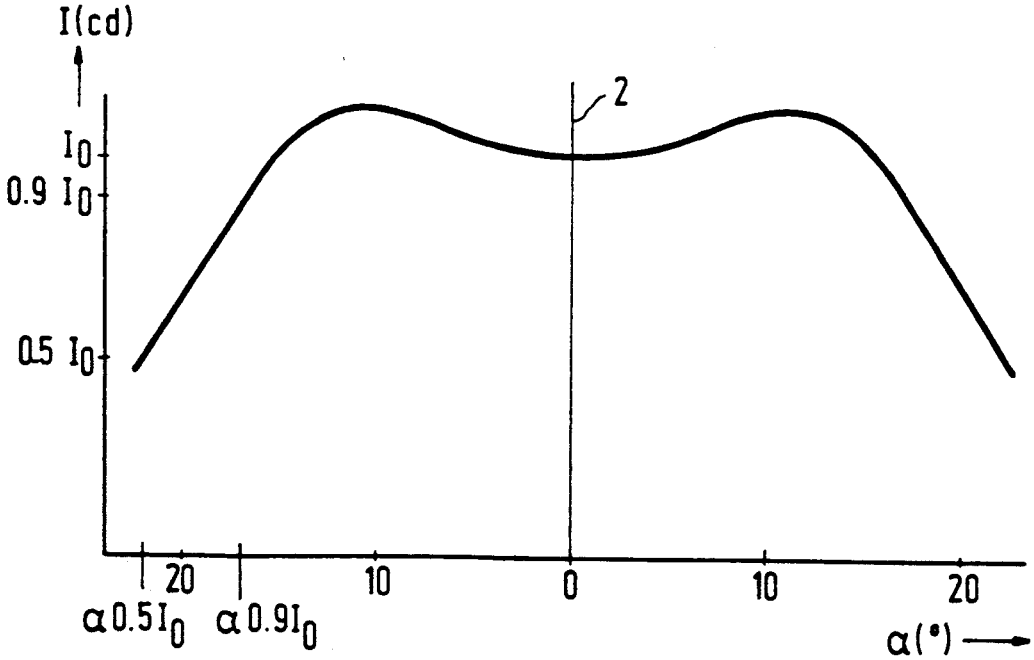
FIG. 2 graphically represents the luminous intensity distribution of the beam formed by the unit of FIG. 1.

FIG. 2 shows the typical light intensity distribution in the light beam formed by the unit of FIG. 1. Starting from the centre of the beam, from the optical axis of the reflector, the luminous intensity I increases around this axis from the value Io to a value lying between 105 and 130, i.e. approximately 112% of Io, at an angle to the optical axis which lies between 5° and 25°, here approximately 11°. The intensity of the beam increases from the centre gradually up to this angle of 11°, and does not reach the value of the beam centre until at an angle of more than 15°. As a result, the unit gives a picture of the scenes illuminated by the unit which is evenly exposed.

Figure 3:
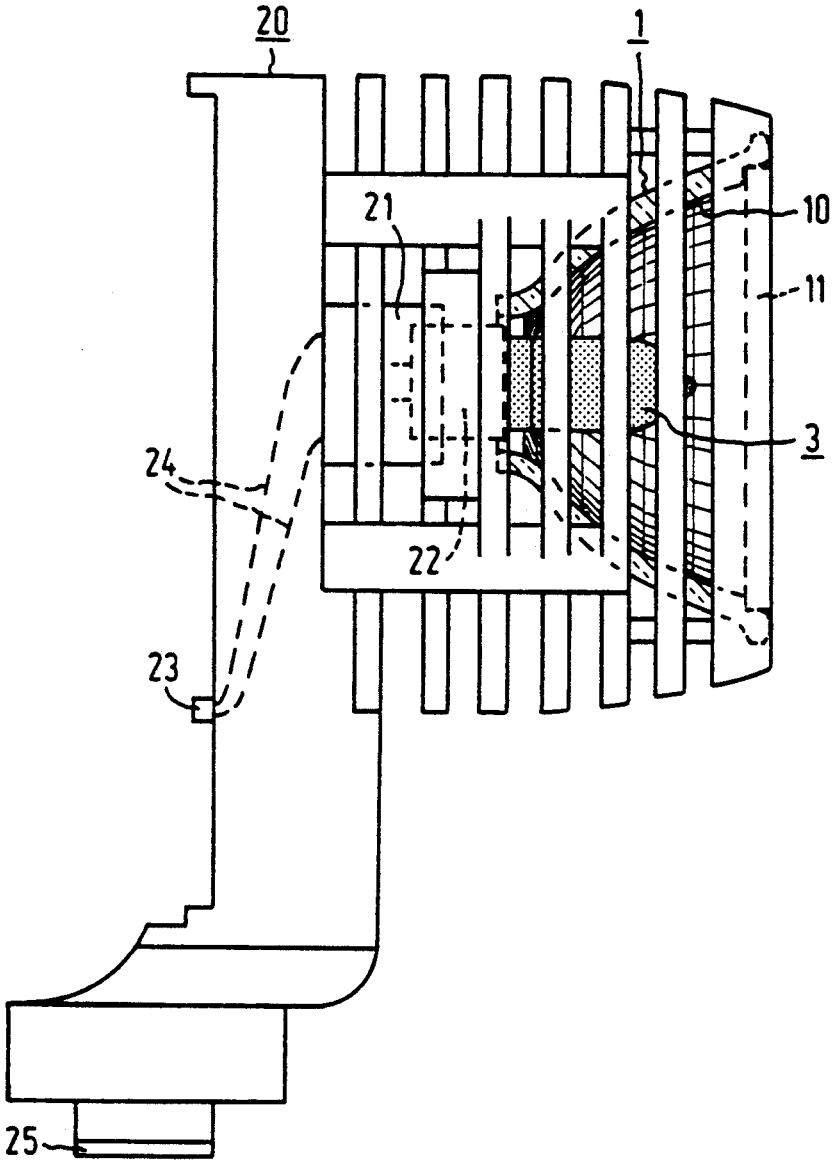
FIG. 3 shows the illumination device in side elevation with the reflector in axial cross-section.

In FIG. 3, the illumination device has a housing 20 in which a lamp-hold 21 is mounted. The lamp cap 22 of an electric lamp 3 (see also FIG. 1) is held in the lampholder 21. A reflector 1 (see also FIG. 1) is inside the housing 20, surrounding the electric lamp 3 with its optical axis 2 coaxial with the electric element of the lamp. The device has contacts 23 for making electrical contacts with a battery means of snap connections. The contacts are connected to the lamphold 21 via cables 24. The device has a base 25 for mounting on a camera.

We claim:

1. An illumination device comprising a housing, a lampholder and a concave reflector disposed in said housing, said reflector having an optical axis;

an electric lamp comprising a light-diffusing lamp vessel, and a light source inside the lamp vessel, said lamp being arranged inside the reflector with said light source substantially coaxial with the reflector, and means for electrically connecting said lamp to said lamp holder;

characterized in that:

said reflector comprises a plurality of axially extending and circumferentially contiguous planar lanes which together define a polygon in cross-sections transverse to said optical axis, said reflector being dimensioned such that it forms a light beam whose intensity around said optical axis, in a direction away from this axis up to a direction which encloses an angle of between 5° and 25° with this optical axis, increases to a value which lies between 105 and 130% of the intensity on the optical axis.

2. An illumination device as claimed in claim 1, characterized in that said reflector has facets.

3. An illumination device as claimed in claim 2, characterized in that said reflector comprises a dichroic mirror.

4. An illumination device as claimed in claim 2, characterized in that a transparent disc closes off said reflector.

5. An illumination device as claimed in claim 4, characterized in that said disc has an interrupted glue connection with said reflector.

6. An illumination device as claimed in claim 2, characterized in that said lamp vessel is satin-frosted.

7. An illumination device as claimed in claim 1, characterized in that said reflector comprises a dichroic mirror.

8. An illumination device as claimed in claim 1, characterized in that a transparent disc closes off said reflector.

9. An illumination device as claimed in claim 8, characterized in that said disc has an interrupted glue connection with said reflector.

10. An illumination device as claimed in claim 1, characterized in that said lamp vessel is satin-frosted.

11. A luminaire, comprising:

a concave reflector having an optical axis; and an electric lamp comprising a light-diffusing lamp vessel and a light source in the lamp vessel, said lamp being arranged inside said reflector with said light source substantially coaxial with said optical axis of said reflector;

said reflector comprising a plurality of axially extending and circumferentially contiguous planar lanes which together define a polygon in cross-sections transverse to said optical axis, said reflector being dimensioned such that it forms a light beam whose intensity around said optical axis, in a direction away from this axis up to a direction which encloses an angle between 5° and 25° with said optical axis, increases to a value which lies between 105 and 130% of the intensity on said optical axis.

12. A luminaire as claimed in claim 11, characterized in that said reflector has facets.

13. A luminaire as claimed in claim 12, characterized in that said reflector comprises a dichroic mirror.

14. A luminaire as claimed in claim 12, characterized in that a transparent disc closes off said reflector.

15. A luminaire as claimed in claim 14, characterized in that said disc has an interrupted glue connection with said reflector.

16. A luminaire as claimed in claim 12, characterized in that said lamp vessel is satin-frosted.

17. A luminaire as claimed in claim 11, characterized in that said reflector comprises a dichroic mirror.

18. A luminaire as claimed in claim 11, characterized in that a transparent disc closes off said reflector.

19. A luminaire as claimed in claim 18, characterized in that said disc has an interrupted glue connection with said reflector.

20. A luminaire as claimed in claim 11, characterized in that said lamp vessel is satin-frosted.

21. An illumination device for obtaining uniformly illuminated photographic images, said device comprising:

a concave reflector defining an optical axis, said reflector comprising a plurality of axially extending and circumferentially contiguous planar lanes which together define a polygon in cross-sections transverse to said optical axis; and an electric lamp comprising a light diffusing lamp vessel and a light source within said lamp vessel, said lamp being arranged within said reflector with said light source axially aligned with said optical axis, the dimensions of said light source and said reflector being selected such that the light beam produced thereby has an intensity at angles of between 5 and 25 degrees with said optical axis which is greater than the intensity on said optical axis and is circumferentially uniform, whereby photographic images of objects illuminated by said light beam taken through the objective of a camera appear uniformly illuminated.

22. An illumination device according to claim 21, wherein said light beam has an intensity within said angles of between 105% and 130% of the intensity of said light beam on said optical axis.

23. An illumination device according to claim 22, wherein each of said planar lanes is faceted.

24. An illumination device according to claim 23, wherein said lamp vessel is satin frosted.

25. An illumination device according to claim 24, further comprising a lamp cap on said reflector, and a housing which includes a lamp holder for receiving said lamp cap.

26. An illumination device according to claim 21, further comprising a lamp cap on said reflector, and a housing which includes a lamp holder for receiving said lamp cap.

27. An illumination device according to claim 21, wherein said lamp vessel is satin-frosted.

28. An illumination device according to claim 21, wherein each of said planar lanes is faceted.

29. An illumination device according to claim 21, wherein said light source is an incandescent filament axially aligned with said optical axis of said reflector.

30. Al illumination device according to claim 21, wherein said light source is comprised of a pair of opposing discharge electrodes aligned with said optical axis, and a discharge sustaining filling with said lamp vessel.

* * * * *

UNITED STATES PATENT AND TRADEMARK OFFICE

CERTIFICATE OF CORRECTION

PATENT NO. : 5,278,744 
DATED : January 11, 1994
INVENTOR(S) : Jaak M.J. Geboers and Manfred Kiesling It is certified that error appears in the above-identified patent and that said Letters Patent is hereby corrected as shown below:

Column 5,
Line 60, change “lampholder” to -- lamp holder --.

Column 6,
Line 8, change “this” to -- said --;
Line 10, change “this” to -- said --;
Line 12, change “the” to -- said --.

Column 8,
Line 24, change “Al” to -- An --.

Signed and Sealed this

Nineteenth Day of November, 2002

*Attest:*

*Attesting Officer*

JAMES E. ROGAN
*Director of the United States Patent and Trademark Office*